United States Patent [19]

Smith

[11] 4,023,321

[45] May 17, 1977

[54] LAYERED ROOFING SHINGLE WITH DEAD-AIR SPACE

[75] Inventor: Robert L. Smith, Newkirk, Okla.

[73] Assignee: Billy G. Powers, Arkansas City, Kans.

[22] Filed: Jan. 30, 1975

[21] Appl. No.: 545,472

[52] U.S. Cl. ..... 52/553; 52/518; 52/528; 52/576; 52/750

[51] Int. Cl.[2] ..... E04D 1/28; E04D 1/30

[58] Field of Search ..... 52/533, 543, 553, 518, 52/528, 615, 305, 576, 750, 302; 428/188, 176

[56] References Cited

UNITED STATES PATENTS

| | | | |
|---|---|---|---|
| 1,765,796 | 6/1930 | Kirschbraun | 52/543 |
| 2,302,487 | 11/1942 | Berger et al. | 52/302 |
| 2,724,872 | 11/1955 | Herbes | 52/302 X |
| 3,006,113 | 10/1961 | Barnes et al. | 52/302 X |
| 3,228,822 | 1/1966 | Norman | 52/615 |
| 3,409,224 | 11/1968 | Harp | 138/121 X |

FOREIGN PATENTS OR APPLICATIONS

| | | | |
|---|---|---|---|
| 182,512 | 12/1954 | Austria | 428/188 |
| 2,250,555 | 4/1974 | Germany | 52/302 |
| 1,203,443 | 10/1965 | Germany | 52/302 |
| 404,226 | 1/1934 | United Kingdom | 428/188 |
| 561,025 | 5/1944 | United Kingdom | 52/518 |

*Primary Examiner*—Leslie Braun
*Attorney, Agent, or Firm*—John A. Hamilton

[57] ABSTRACT

A roofing shingle consisting of an upper layer of composition roofing material, a lower layer of waterproof roofing felt, and an intermediate layer spacing the upper and lower layers apart, all of the layers being firmly bonded together. The intermediate layer may function to provide a dead-air space for purposes of heat insulation, or may consist of tubular members permitting free circulation of air between the upper and lower layers. The composite structure of the shingle gives it a bending strength highly resistant to curling or other damage by high wind, and the lower layer may be extended to underlie adjacent shingles in the same course, so as to provide a waterproof under-layer for the upper layers.

2 Claims, 6 Drawing Figures

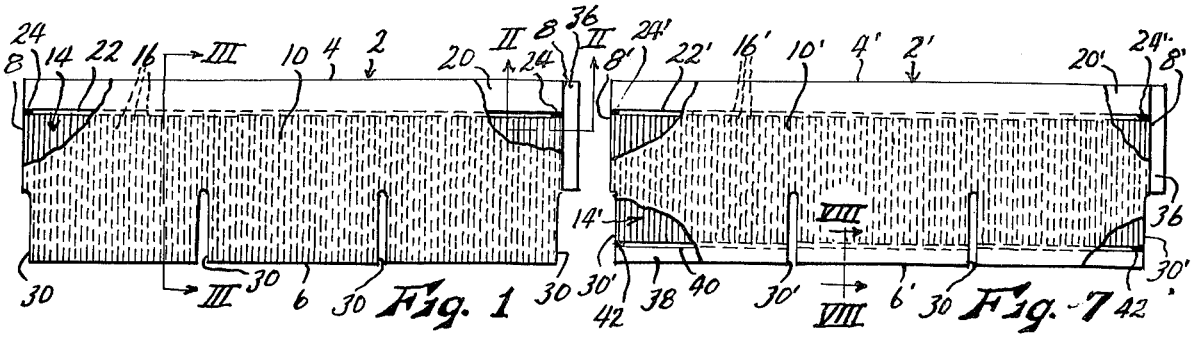
Fig. 1
Fig. 7
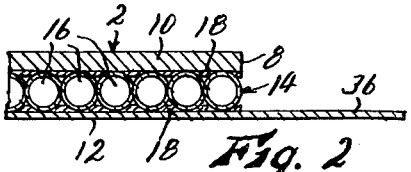
Fig. 2
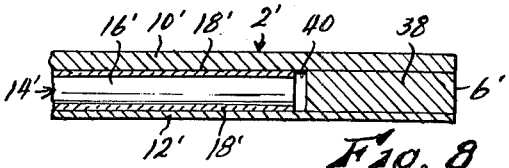
Fig. 8
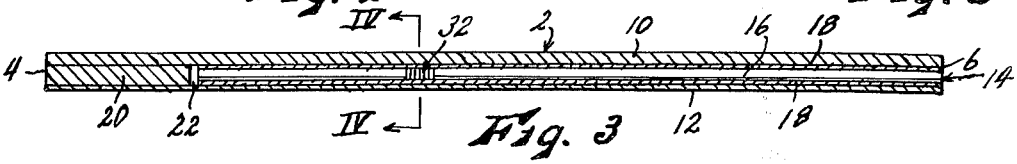
Fig. 3
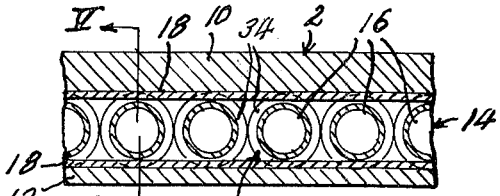
Fig. 4
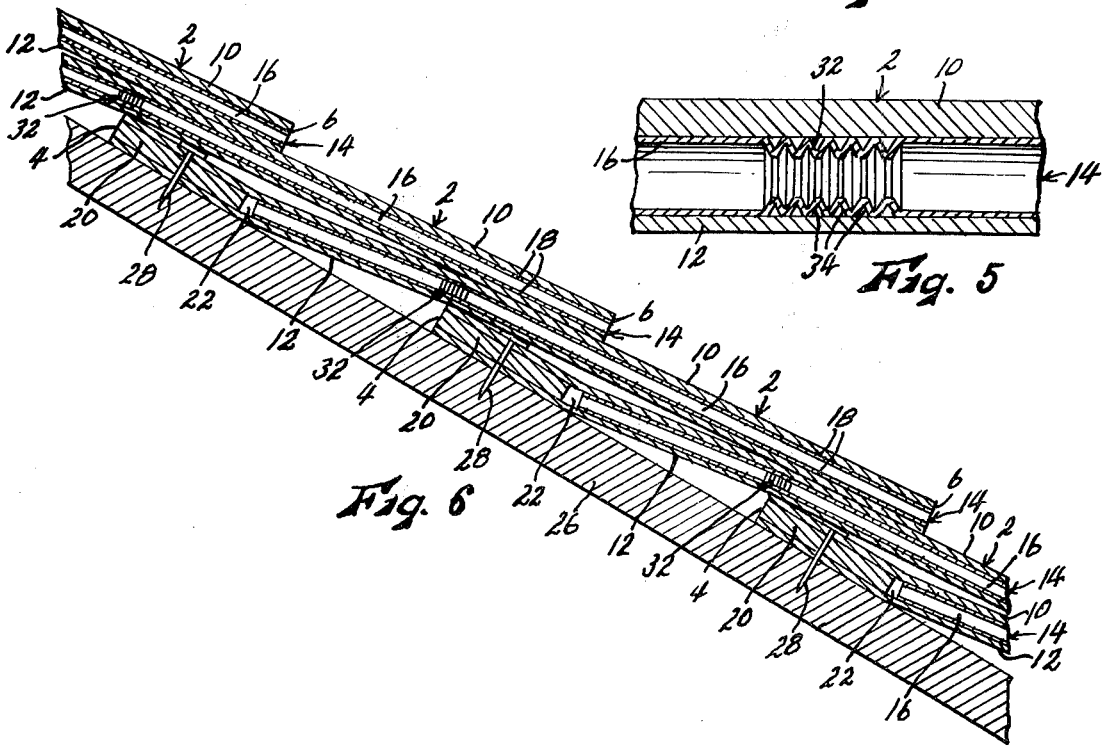
Fig. 6
Fig. 5

LAYERED ROOFING SHINGLE WITH DEAD-AIR SPACE

This invention relates to new and useful improvements in roofing shingles.

The principal object of the present invention is the provision of a roofing shingle, basically of the type consisting of a thick asphalt composition layer to the outer surface of which is bonded a layer of fine, granular chat, having means providing an air space beneath said composition layer for purposes of heat insulation providing protection against the transfer of heat inwardly through the shingled roof in hot weather, and outwardly through the roof in cold weather.

Generally, this object is accomplished by the provision of a shingle having three layers, an outer or upper layer of ordinary composition roofing, a lower layer of any suitable material such as roofing felt, or "tarpaper", and a thick intermediate layer so constructed as to provide an air space between the upper and lower layers. The air space may be substantially closed or sealed, whereby to provide a dead-air-space type of insulation, or may be constructed to provide for free circulation of outdoor air between the upper and lower layers, whereby to provide a still better protection against heat transfer through the roof.

Another object is the provision of a shingle of the character described which is relatively stiff and resistant to bending or flexure thereof transversely to its plane, whereby to resist peeling or curling of the shingles by high wind. This stiffness is provided by the design and structure of the intermediate layer of the shingle.

A further object is the provision of a shingle of the character described which, despite its stiffness, will lie neatly and flatly on the roof even when they are applied in the usual overlapping pattern. This effect is provided by weakening the intermediate layer along selected lines.

A still further object is the provision of a shingle of the character described which does away with the necessity of applying a "dry-ply", usually a sheet of roofing felt, over the roofing boards before applying the shingles, as is customary. This effect is provided by forming the inner layer of the shingle itself of roofing felt, and extending it beyond the upper layer at one side of the shingle, so as to underlie the adjacent shingle in the same course of shingles as they are applied.

Other objects are simplicity and economy of structure, and efficiency and dependability of operation.

With these objects in view, as well as other objects which will appear in the course of the specification, reference will be had to the accompanying drawing, wherein:

FIG. 1 is a face view of a roofing shingle embodying the present invention, with portions broken away, FIG. 2 is an enlarged, fragmentary sectional view taken on line II—II of FIG. 1, FIG. 3 is an enlarged sectional view taken on line III—III of FIG. 1, FIG. 4 is an enlarged, fragmentary sectional view taken on line IV—IV of FIG. 3, FIG. 5 is a fragmentary sectional view taken on line V—V of FIG. 4, FIG. 6 is a fragmentary sectional view of a roof, taken along a line parallel to the slope thereof, showing a plurality of courses of the present shingles applied thereto, FIG. 7 is a view similar to FIG. 1, showing a slight modification of structure, and FIG. 8 is an enlarged, fragmentary sectional view taken on line VIII—VIII of FIG. 7.

Like reference numerals apply to similar parts throughout the several views, and the numeral 2 applies generally to a roofing shingle constructed according to the present invention. Said shingle is generally rectangular in shape, and for convenience one of the longer edges 4 thereof will be designated its upper edge, its opposite longer edge 6 will be designated its lower edge, and its shorter edges 8 will be designated its side edges.

In the form of the shingle shown in FIGS. 1–6, each shingle 2 consists of an outer layer 10, which may comprise ordinary asphaltic composition roofing material, an inner layer 12, which may consist of a layer of roofing felt, or "tarpaper", and an intermediate layer designated generally by the numeral 14, disposed between outer layer 10 and inner layer 12. As shown, said intermediate layer includes of a continuous series of tubes 16 formed of plastic or other suitable material, disposed in side-by-side relation, touching or nearly touching each other, and extending in parallel relation between upper edge 4 and lower edge 6 of the shingle, parallel to side edges 8. The tubes are connected to said outer and inner layers by roofing cement 18 or other suitable adhesive material. These tubes, which resemble soda straws, are open throughout their lengths and at both ends, and are preferably of a diameter somewhat greater than the thickness of composition roofing outer layer 10 of the shingle. The lower ends of the tubes extend flush with and open through lower edge 6 of the shingles, but terminate at their upper ends short of upper shingle edge 4, along a line parallel to edge 4. The remaining space between outer and inner layers 10 and 12 is largely filled with a spacer strip 20, which may also be of composition roofing material, having a thickness equal to the diameter of tubes 16, and being cemented to said outer end inner layers. Said spacer is, however, spaced slightly apart from the upper ends of tubes 16, leaving an air passage 22 therebetween. The ends of said passage are sealed as by roofing cement, as indicated at 24 in FIG. 1.

In applying shingles as thus far described to the boards 26 of a sloping roof as shown in FIG. 6, the lowermost course of shingles is applied in a horizontal line transverse to the roof slope, with side edges 8 of adjacent shingles abutting, and secured by nails 28 driven through the shingles adjacent their upper edges 4. The next higher course of shingles is then applied, being offset upwardly along the roof slope to leave a portion of the top surface of the shingles of the lower course exposed to the weather, and nailed in place in the same manner as the lower course. This of course is the usual manner of applying roofing shingles, well known in the art. In the present case, nails 28 may be driven through the top edge portion of each shingle occupied by spacer 20, the spacers thus providing support for the nail heads, and preventing any possibility that tubes 16 could be crushed by hammer blows. The individual shingles of adjacent courses are staggered horizontally relative to each other to avoid leaving cracks between the shingles through which rain or other moisture could pass directly to roofing boards.

Preferably somewhat less than half of the width of a shingle between its upper and lower edges is exposed to the weather. For example, if the shingle is 12 inches wide, perhaps 5 inches thereof adjacent its lower edge 6 is exposed to the weather, so that 7 inches of the shingles in the next higher course of shingles will overlie the tops of the shingles in the next lower course. In this manner, the entire area of the roof will be covered by at least a double layer of shingles, which is considered to be desirable. This is called "double-roofing". The shingle may be notched inwardly from its lower edge at intervals along its length, as indicated at 30 in FIG. 1, to give a decorative effect causing the shingles to resemble wood shingles when they are applied to the roof. These notches should extend no farther from the lower shingle edge 6 than that portion of the shingle which is to be exposed to the weather, or 5 inches in the exemplary dimensions discussed above.

The lower ends of the tubes 16 are then open to the atmosphere at the exposed edges of the shingles, and their upper ends open in air passages 22. This permits a generally free circulation of outdoor air between the outer and inner layers of the shingles, which does much to reduce and inhibit the transfer of outdoor heat through the shingles and roof during hot weather. The slope of the tubes together with their long lengths as compared to their diameters, renders it unlikely that any rain or other moisture will be blown all the way upwardly therethrough to enter beneath the shingles. Nevertheless, some water might be blown all the way to the tops of the tubes, particularly in the span of notches 30, wherein the tubes are necessarily shorter. However, any such water enters air passage 22, which is sealed, so that said water can escape only by again flowing downwardly through the tubes to the outer surface of the next lower course of shingles.

It will be seen also that tubes 16, although individually of no great strength, will nevertheless by virtue of their large number and the fact that they are cemented firmly to outer and inner layers 10 and 12, impart a greatly increased strength to each shingle against flexure normally to its plane. This added stiffness greatly increases the resistance of the shingles to upward curling or "peeling" of the unsecured lower edge portions thereof in high winds. Damage resulting from this cause during windstorms is of course very common.

Nevertheless, the stiffness imparted to a shingle by tubes 16 could also prevent the shingles from lying flat on the roof. That is, while the tubes do not render the shingles absolutely rigid, it will be seen that when the upper edge of a shingle is secured by nails 28, it must first be angled outwardly from the roof boards in order to pass over the rearward edge of the next lower shingle. This could create problems in driving the nails with sufficient force to bring the top portion of the shingle flush against the board, and also result in an uneven or irregular bending or folding of the shingle. Also, the lower edge 6 of the shingle would then be spaced upwardly apart from the top surface of the next lower shingle. To prevent these occurrences, the tubes 16 are weakened in bending strength along a line 32 parallel to the upper and lower edges 4 and 6 of the shingle and spaced apart from lower edge 6 of the shingle by a distance equal to the distance said shingle will overlie the next lower shingle, or 7 inches in the exemplary dimensions discussed above. This weakening is accomplished by forming a short series of accordian-type folds 34 in the wall of the tube, as best shown in FIGS. 4 and 5, thus rendering the tubes easily bendable at the desired points. Nails 28 are driven through the shingles in the area thereof including spacer 20. The shingle may thus bend relatively freely at the line of air passage 22, since there are no tubes present along this line, to angle outwardly from the roof boards to pass over upper edge 4 of the next lower shingle, and then bend downwardly at line 32; which is disposed directly over edge 4 of the next lower shingle, to rest neatly against the top surface of the lower shingle, as shown in FIG. 6. The bending of the shingle as described is not freely or pliably flexible, but the folding at air passage 22 will be forced when nails 28 are driven and the folding at line 32 will occur gradually by gravity due to the weight of the shingle after the shingles are applied. The stiffness of the shingles imparted by tubes 16 still offers good protection against wind peeling or curling thereof despite the weakening at the desired lines. Both the composition roofing of outer shingle layer 10 and the roofing felt inner layer 12 are amply yieldable in their own planes, both in tension and compression, to resist breakage or tearing thereof at the bend lines with the small degree of flexure required.

The use of roofing felt, or other suitable waterproof sheet material, as the inner layer 12 of the present shingle, virtually eliminates any necessity of the usual practice of applying a separate "dry-ply" over the roofing boards, usually a layer of the same roofing felt, before applying the shingles, when ordinary shingles are used. The waterproofing supplied by inner layers 12 of the present shingles is quite effectively continuous and uninterrupted so long as the courses are overlapped as shown, and the shingles in each course are horizontally staggered relative to the shingles in adjacent courses. Nevertheless, a final improvement in this "dry-ply" effect is provided by extending layer 12 outwardly from one side edge 8 of each shingle to form a tab 36 extending along only that portion of the width of the shingle not exposed to the weather, or along the top 7 inches of said side edge in the exemplary dimensions given above. As each shingle is applied, the side edge thereof having no tab overlies the tab of the previously applied shingle in the same horizontal course, and preferably at least one of nails 28 is so placed as to pierce tab 32 and the shingle overlying it. This virtually eliminates any possibility of the leakage of water between the abutting side edges of adjacent shingles.

FIGS. 7 and 8 show a shingle 2′ of slightly modified construction, which is substantially identical to that shown in FIGS. 1–6, corresponding parts being indicated by corresponding primed numerals, except that the plastic tubes 16′ terminate inwardly from lower edge 6′ of the shingle, and the resulting space between inner and outer layers 10′ and 12′ of the shingle is filled by a narrow spacer strip 38 of composition roofing material which is permanently bonded to outer layer 10′ and inner layer 12′. Any slight spacing 40 between spacer 38 and the tube ends is sealed at its ends by roofing cement, as indicated at 42. This spacer obstructs and largely prevents any free circulation of outdoor air through tubes 16′, such as occurs in the species of the invention shown in FIGS. 1–6, so that the heat insulation provided by the air trapped in the tubes is largely of the "dead air space" type. The strip also provides a neater, more finished appearance to the completed roof. It will be seen that since the air circulating in tubes 16 in the shingle of FIGS. 1–6 is outdoor air, it is primarily effective in preventing the heat of the sun-warmed outer layer 10 inwardly through the roof, while if the building interior is heated, as in cold weather, such circulation would result in more direct loss of building heat to the outside atmosphere. In the latter case, the dead air space provided by the shingles of FIGS. 7–8 would be more effective. Accordingly, the shingles of FIGS. 1–6 are considered preferable in warm climates, where the building interior is most often cooler than the outside atmosphere, while the shingles of FIGS. 7–8 are preferable in colder climates, where the building interior is most often warmer than the outside atmosphere.

While I have shown and described certain specific embodiments of my invention, it will be readily apparent that many minor changes of structure and operation could be made without departing from the spirit of the invention.

What I claim as new and desire to protect by Letters Patent is:

1. A generally rectangular roofing shingle adapted to be applied to a sloping roof so as to have upper and lower edges transverse to the slope of the roof and side edges parallel to said slope, said shingle comprising:

a. an outer layer of flexible material, b. an inner layer of flexible material, c. an intermediate layer providing an air space between outer and inner layers, said intermediate layer comprising a series of generally parallel tubular members extending at right angles to the upper and lower edges of the shingle, each of said tubular members opening through the lower edge of said shingle and terminating in spaced relation below the upper edge of the shingle, and a spacer strip of solid, flexible material disposed between said outer and inner layers between the upper ends of said tubular members and the upper edge of said shingle, said spacer strip being spaced apart from the upper ends of said tubular members whereby to form an air passage interconnecting all of said tubular members at their upper ends, and means sealing the ends of said air passage at the respective side edges of said shingle, and d. means bonding said outer, inner and intermediate layers together to form a unitary structure, said shingle being adapted to be secured to a roof structure adjacent its upper edge, whereby said elongated tubular members of said intermediate layer serve to stiffen said shingle against flexure normally to its plane about any axis parallel to its upper and lower edges.

2. A shingle as recited in claim 1 wherein the tubular members of said intermediate layer terminate short of the lower edge of said shingle, and with the addition a spacer strip of solid, flexible material secured between the lower edge portions of said outer and inner layers, below said tubular members, and extending to the lower edge of said shingle.

* * * * *